United States Patent [19]

Stettler et al.

[11] 4,388,205

[45] Jun. 14, 1983

[54] PHOSPHATE-FREE CLEANING COMPOSITIONS

[75] Inventors: Hans Stettler; Karl Buser, both of Basel, Switzerland; Jean-Pierre Chavannes, Saint-Louis, France

[73] Assignee: Sandoz Ltd., Basel, Switzerland

[21] Appl. No.: 318,691

[22] Filed: Nov. 6, 1981

Related U.S. Application Data

[63] Continuation-in-part of Ser. No. 310,997, Oct. 13, 1981, abandoned.

[30] Foreign Application Priority Data

Oct. 11, 1980 [DE] Fed. Rep. of Germany ..... 3038434

[51] Int. Cl.[3] ..... C11D 3/08; C11D 7/26; C11D 10/02

[52] U.S. Cl. ..... 252/135; 252/156; 252/173; 252/174.18; 252/174.24

[58] Field of Search ..... 252/135, 156, 173, 174.18, 252/174.24

[56] References Cited

U.S. PATENT DOCUMENTS

| | | | |
|---|---|---|---|
| 2,976,248 | 3/1961 | Otrhalek | 252/156 |
| 2,992,998 | 7/1961 | Karabinos et al. | 252/156 |
| 3,308,067 | 3/1967 | Diehl | 252/161 |
| 3,764,559 | 10/1973 | Mizuno et al. | 252/99 |
| 3,839,215 | 10/1974 | Mulders | 252/181 |
| 4,215,004 | 7/1980 | Borgerding et al. | 252/156 |

*Primary Examiner*—John E. Kittle
*Assistant Examiner*—Robert A. Wax
*Attorney, Agent, or Firm*—Gerald D. Sharkin; Richard E. Vila; Thomas C. Doyle

[57] ABSTRACT

A liquid phosphate-free wash additive composition comprises an aqueous solution of the following active compounds:

(A) 100 parts by weight of a polycarboxylic acid in the salt form (B) 2 to 400 parts by weight of an alkali metal gluconate or glucoheptonate (C) 20 to 700 parts by weight of an alkali metal metasilicate, and (D) 10 to 150 parts by weight of an alkali metal hydroxide.

20 Claims, No Drawings

PHOSPHATE-FREE CLEANING COMPOSITIONS

This application is a continuation-in-part of our copending application Ser. No. 310,997, filed Oct. 13, 1981, now abandoned.

The present invention relates to a liquid phosphate-free wash additive composition and to a phosphate-free or low-phosphate detergent containing such an additive.

Strong detergents, particularly those used in industrial laundries, contain relatively high amounts of phosphates, e.g. more than 30% of pentasodium polyphosphate, in association with soaps, surfactants, carboxymethylcellulose and silicates. The use of phosphates being limited by ecological considerations, detergents which are essentially free of phosphates have been marketed; however, these detergents do not have a satisfactory cleaning power, particularly in the case of strongly soiled textiles, e.g. hospital linens. Furthermore, they may damage washing machines and confer an undesirable handle to the washed goods.

A highly active, phosphate-free wash additive has now been found which can be used in place of the ecologically unacceptable phosphates.

Accordingly, the invention provides a wash additive composition comprising an aqueous solution of the following components:

(A) 100 parts by weight of a polycarboxylic acid in the salt form (B) 2 to 400 parts by weight of an alkali metal gluconate or glucoheptonate (C) 20 to 700 parts by weight of an alkali metal metasilicate, and (D) 10 to 150 parts by weight of an alkali metal hydroxide.

The aqueous composition of the invention contains preferably the sum of the above 4 active components in a total amount (dry weight) from 20 to 70% by weight, preferably from 20 to 50% by weight.

Suitable compounds for component (A) are polycarboxylic acids containing carboxylic acid groups at least partially neutralized in the salt form, with a molecular weight from 160 to 1,000,000, preferably from 500 to 500,000, more preferably from 1,000 to 80,000. They may be linear and/or crosslinked and may contain, in addition to the carboxylic acid groups, further functional groups, preferably such which are derived from the carboxylic acid function.

Examples of suitable polycarboxylic acids include monomeric polycarboxylic acids such as citric acid, homopolymers of acrylic acid, methacrylic acid, α-hydroxy-acrylic acid, maleic acid, crotonic acid, isocrotonic acid, itaconic acid, mesaconic acid, aconitic acid, methylenemalonic acid, citraconic acid and copolymers of such acids with one another or with one or more further ethylenically unsaturated compounds. Such copolymers with ethylenically unsaturated comonomers may contain up to 80% by weight of the latter monomers, preferably from 1 to 50% by weight, more preferably from 1 to 20% by weight. As examples of ethylenically unsaturated monomers, copolymerizable with the above mentioned acids, may be given ethylene, propylene, alkyl($C_1$–$C_4$) or hydroxyalkyl($C_1$–$C_4$)acrylate, alkyl($C_1$–$C_4$) or hydroxyalkyl($C_1$–$C_4$)methacrylate, alkyl ($C_1$–$C_4$)α-hydroxyacrylate, acrylamide, methacrylamide, acrylonitrile, methacrylonitrile, acrolein, vinyl ethers, vinyl esters of ($C_1$–$C_5$)carboxylic acids, e.g. vinyl acetate, vinyl alcohol, furan etc.

Preferred polycarboxylic acids for component (A) are polyacrylic acid and poly-α-hydroxyacrylic acid.

According to the invention, the polycarboxylic acid component (A) is present in the composition in the salt form, i.e. all the carboxylic acid groups present in the polymer are in salt form. Suitable salts are obtained by partial or full neutralization of the polycarboxylic acid with an alkali metal hydroxide, e.g. sodium or potassium hydroxide or an alkali metal salt such as sodium or potassium carbonate. The polycarboxylic acid component (A) may be added in an at least partially neutralized form; in this case, the carboxylic acid groups of component (A) must be partially neutralized in such a proportion that on addition of component (D) they are fully neutralized and the composition has an alkaline pH. The polycarboxylic acids (A) are preferably used in the potassium salt form, more preferably all the carboxylic acid groups are in potassium salt form.

Component (B) is preferably sodium or potassium gluconate or glucoheptonate, more preferably potassium gluconate.

Component (C) is preferably a sodium or potassium metasilicate, in anhydrous or hydrated form, e.g. of formula $M_2SiO_3$, $9H_2O$ where M is sodium or potassium, preferably potassium.

Component (D) is preferably sodium or potassium hydroxide, more preferably the latter.

The wash additive composition of the invention has an alkaline pH, preferably a pH higher than 10.

Preferred proportions of the active components (A) to (D) in the mixture (not taking into account the water present) are as follows. All percentages are by weight.

| | | | |
|---|---|---|---|
| (Component A) | 35–75% | preferably | 35–60% |
| (Component B) | 2.5–25% | preferably | 5–15% |
| (Component C) | 20–45% | preferably | 25–40% |
| (Component D) | 5–30% | preferably | 5–25% |

The wash additive composition may be prepared by adding the components, preferably either in the order in which they are described above or in the order A, B, D and C, to demineralised water and stirring until the mixture is homogeneous. Component (A) is preferably added in form of an aqueous solution having a low viscosity.

The wash additives of the invention may be used in combination with commercially available detergents. Such detergents may be either phosphate-free or low-phosphate. The composition of the invention may be incorporated into detergents, in which case such detergents form part of the invention, or may be added together with or separately from the detergent to the goods to be washed. The wash additive is preferably used in association with phosphate-free detergents, e.g. as disclosed in U.K. patent application No. 2,068,405 and containing the following active components:

(A) 2 to 35 parts by weight of a higher ($C_{8-24}$) alkylphenyl polyglycol ether having from 5 to 25 glycol residues, or a mixture thereof, (B) 5 to 35 parts by weight of an alkanolamine, and (C) 0.5 to 6 parts by weight of a cation sequestering agent.

The wash additive of the invention may also be used together or mixed with a surfactant, preferably an anionic or non-ionic surfactant, e.g. as commonly used in the detergent industry, preferably sulphonates such as alkylarylsulphonates, or polyglycol ethers such as alkylphenyl polyglycol ethers or the addition products of alkylene oxide to fatty alcohols. The wash additive together with a surfactant gives also an active detergent.

Further ingredients such as optical brightening agents, bleaching agents, e.g. perborates, perfumes and the like, may be added to the wash additive or the detergent of the invention. The wash additive may also be mixed with soaps, preferably soft soap, in an amount up to 20% by weight.

Due to its cleaning properties, the wash additive of the invention may also be used per se as a detergent, particularly for the prewashing step. Furthermore, it may be employed for the washing treatment of textile substrates dyed or printed with a fiber-reactive dye, in order to remove the hydrolysed and unfixed reactive dye and thereby to improve the fastness of the dyeings and printings, particularly the wet and rubbing fastnesses.

The amount of wash additive to be used may vary depending on the soil degree. Satisfactory results are generally obtained when it is used in an amount from 0.1 to 60 g/kg, preferably from 1 to 40 g/kg of goods to be washed. When the wash additive is used in combination with a detergent or a surfactant, the weight ratio of the wash additive to the detergent or surfactant is suitably 0.5–5:1, preferably 0.5–1,5:1.

The wash additive of the invention used alone or together with a detergent has a powerful cleaning action, particularly against resistant stains such as blood, albumen, carbon, graphite, dyestuffs, oils, grease etc. It is indicated for the washing (pre-, main- and/or after-washing) of dyed or undyed natural and regenerated cellulose fibres, e.g. cotton, linen, viscose staple fibers, and polyamides or polyester/cellulosic fibre blends; it may be used for domestic purposes or in industrial laundries for the cleaning of e.g. hospital, hotel and institutional linens, workwear, overalls etc. It can be used in the normal industrial laundries, e.g. discontinuous washing machines such as wash centrifuges and continuous machines such as washing tunnels.

The wash additive of the invention is biodegradable and does not give rise to foam. Its efficiency is not altered in the presence of hard water. Furthermore, it is stable on storage and has no corrosive or abrasive action on the washing machines.

The wash additive composition of the invention may also be mixed with cleaning formulations, e.g. cleaning powders, for domestic or industrial uses.

A representative composition of the invention is one containing components (A), (B), (C) and (D) in the following proportions:

100 parts by weight of component (A)
30 to 300 parts by weight of component (B)
20 to 600 parts by weight of component (C)
10 to 100 parts by weight of component (D).

The following Examples, in which all parts and percentages are by weight, illustrate the invention. The temperatures are indicated in centigrade degrees.

EXAMPLE 1

To a container are added at room temperature 200 parts demineralised water. The following components are then added singly in the order given, with continuous stirring. As each component is added, stirring is continued until mixing is complete before addition of the next component.

400 parts commercial polyacrylic acid sodium salt in 40% aqueous solution (Molecular weight ~3000)
100 parts sodium glucoheptonate
100 parts sodium hydroxide 30%, and
120 parts anhydrous sodium metasilicate.

After a stirring for a further 10 minutes—1 hour (according to the size of the batch), the composition is ready for use.

EXAMPLE 2

Example 1 is repeated, except that the initial quantity of water used is 150 parts and 100 parts anhydrous sodim metasilicate are taken.

EXAMPLE 3

Example 1 is repeated, except that the initial quantity of demineralised water used is 500 parts and 120 parts of poly-α-hydroxyacrylic acid sodium salt (MW ~3000) are taken.

EXAMPLE 4

Example 1 is repeated except that the following components are used:

400 parts poly-α-hydroxyacrylic acid potassium salt (MW ~5000) (40%)
30 parts potassium gluconate
110 parts potassium metasilicate
150 parts potassium hydroxide 50%.

Polyacrylic acid potassium salt (MW ~5000) and potassium glucoheptonate may be used instead of poly-α-hydroxyacrylic acid potassium salt and potassium gluconate.

EXAMPLE 5

White hospital or hotel linens moderately soiled are washed in a continuous washing tunnel in the presence of 3 to 6 g/kg linen of a commercially available detergent, e.g. such as disclosed in U.K. patent application No. 2,068,405, and 5 to 10 g/kg linen of the wash additive composition, e.g. a composition of Example 1, 2, 3 or 4. The liquor to goods ratio is 4:1.

After washing and rinsing, perfectly white cleaned linens are obtained.

EXAMPLE 6

Heavily soiled polyester/cotton protective clothing is washed in a wash centrifuge. The pre-washing is carried out for 5 minutes at a temperature of from 30°–40° with 4 to 6 g/kg clothing of a commercially available surfactant based on an alkylbenzenesulphonate, and 5 to 7 g/kg clothing of the wash additive composition of Example 1, 2, 3 or 4. A first main washing is performed at a temperature of 80° for 8 minutes with 4 to 8 g/kg clothing of the same surfactant and 13 to 8 g/kg clothing of the wash additive composition. Subsequently the clothing is submitted to a second main washing effected at 85°–90° for 7 to 10 minutes in the presence of 2.5 to 3.5 g/kg clothing of the same surfactant and 13 to 8 g/kg clothing of the wash additive composition. In each washing step, the liquor to clothing ratio is 5:1.

After rinsing, the washed clothing is perfectly clean.

What we claim is:

1. A phosphate-free aqueous composition comprising
(A) 100 parts by weight of a polycarboxylic acid in the salt form (B) 2 to 400 parts by weight of an alkali metal gluconate or glucoheptonate (C) 20 to 700 parts by weight of an alkali metal metasilicate, and (D) 10 to 150 parts by weight of an alkali metal hydroxide.

2. A composition according to claim 1, wherein component (A) is a polycarboxylic acid alkali metal salt having a molecular weight from 160 to 1,000,000.

3. A composition according to claim 1, wherein component (A) is citric acid, an homopolymer of acrylic acid, methacrylic acid, α-hydroxy-acrylic acid, maleic acid, crotonic acid, iso-crotonic acid, itaconic acid, mesaconic acid, aconitic acid, methylenemalonic acid or citraconic acid, or a copolymer of such acids with one another or with one or more further ethylenically unsaturated compounds, in the alkali metal salt form.

4. A composition according to claim 1, wherein component (A) is polyacrylic or poly-α-hydroxyacrylic acid alkali metal salt.

5. A composition according to claim 1, wherein the alkali metal is sodium or potassium.

6. A composition according to claim 1, wherein the total amount of the 4 components (A) to (D) (dry weight) is from 20 to 70% by weight.

7. A composition according to claim 1, wherein the active components are present in the following proportions by weight, excluding the water present:

(A) 35–75%

(B) 2.5–25%

(C) 20–45%

(D) 5–30%.

8. A composition according to claim 3 wherein any copolymer of a carboxylic acid with a further ethylenically unsaturated comonomer as component (A) contains said ethylenically unsaturated comonomer in an amount of from 1 to 50% by weight, said comonomer being ethylene, propylene, alkyl($C_1$–$C_4$) or hydroxyalkyl($C_1$–$C_4$)acrylate, alkyl($C_1$–$C_4$) or hydroxyalkyl($C_1$–$C_4$)methacrylate, alkyl($C_1$–$C_4$)α-hydroxyacrylate, acrylamide, methacrylamide, acrylonitrile, methacrylonitrile, acrolein, a vinyl ether, a vinyl ester of ($C_1$–$C_5$) carboxylic acid, vinyl alcohol or furan.

9. A composition according to claim 2 wherein all the carboxylic acid groups of the polycarboxylic acid comprising component (A) are in salt form, component (B) is sodium or potassium gluconate or glucoheptonate, component (C) is anhydrous or hydrated sodium or potassium metasilicate and component (D) is sodium or potassium hydroxide.

10. A composition according to claim 9 containing components (A), (B), (C) and (D) in a total amount of 20 to 70% (dry weight) based on the weight of the composition.

11. A composition according to claim 10 having a pH higher than 10.

12. A composition according to claim 11 wherein components (A), (B), (C) and (D) are present in the following proportions, excluding water:

(A) 35–60%

(B) 5–15%

(C) 25–40%

(D) 5–25%

13. A process for cleaning goods which comprises washing the goods in water containing a cleaning-effective amount of a composition according to claim 1.

14. A process according to claim 13 wherein the water also contains a detergent or an anionic or nonionic surfactant.

15. A process according to claim 13 wherein the composition contains components (A), (B), (C) and (D) in a total amount, based on dry weight, of 20 to 70% by weight, and is present in an amount of 0.1 to 60 g/kg goods to be washed.

16. A process according to claim 14 wherein the composition contains components (A), (B), (C) and (D) in a total amount, based on dry weight, of 20 to 70% by weight and the weight ratio of the composition to the detergent or surfactant is 0.5–5:1.

17. A composition according to claim 6 wherein component (A) is polyacrylic or poly-α-hydroxyacrylic acid alkali metal salt.

18. A composition according to claim 7 wherein component (A) is polyacrylic or poly-α-hydroxyacrylic acid alkali metal salt.

19. A composition according to claim 11 wherein component (A) is polyacrylic or poly-α-hydroxyacrylic acid alkali metal salt.

20. A composition according to claim 15 wherein component (A) is polyacrylic or poly-α-hydroxyacrylic acid alkali metal salt.

* * * * *